US010604975B2

(12) United States Patent
Hunt

(10) Patent No.: US 10,604,975 B2
(45) Date of Patent: Mar. 31, 2020

(54) REVERSIBLE ACTIVATION UNIT FOR ALTERNATE IMPINGEMENT OF TWO SEPARATE MOTOR VEHICLE FUNCTIONAL ELEMENTS

(71) Applicant: Kiekert AG, Heiligenhaus (DE)

(72) Inventor: Robert J. Hunt, Davisburg, MI (US)

(73) Assignee: Kiekert AG, Heiligenhaus (DE)

( * ) Notice: Subject to any disclaimer, the term of this patent is extended or adjusted under 35 U.S.C. 154(b) by 585 days.

(21) Appl. No.: 15/422,563

(22) Filed: Feb. 2, 2017

(65) Prior Publication Data

US 2018/0216378 A1 Aug. 2, 2018

(51) Int. Cl.
*E05B 81/24* (2014.01)
*E05B 81/00* (2014.01)
(Continued)

(52) U.S. Cl.
CPC ..... *E05C 9/16* (2013.01); *E05B 81/01* (2013.01); *E05B 81/06* (2013.01); *E05B 81/13* (2013.01);
(Continued)

(58) Field of Classification Search
CPC ..... E05B 81/00; E05B 81/01; E05B 81/06; E05B 81/13; E05B 81/14; Y10T 292/084; Y10T 292/0841; Y10T 292/0854; Y10T 292/0855; Y10T 292/1021; Y10T 292/1047; Y10T 292/1082; Y10T 292/1097; Y10S 292/21; Y10S 292/23; Y10S 292/42; Y10S 292/68
(Continued)

(56) References Cited

U.S. PATENT DOCUMENTS 2,839,912 A * 6/1958 Corbin ..... E05B 83/16 70/141
4,157,844 A * 6/1979 Sarosy ..... E05B 83/16 292/216

(Continued)

FOREIGN PATENT DOCUMENTS

DE 38 07 087 A1 9/1989
WO 1999/019180 A1 4/1999

OTHER PUBLICATIONS

International Search Report and Written Opinion dated Apr. 19, 2018 for International Application No. PCT/IB2018/000035.

*Primary Examiner* — Carlos Lugo
(74) *Attorney, Agent, or Firm* — Renner, Otto, Boisselle & Sklar, LLP

(57) ABSTRACT

The object of the invention is a reversible activation unit for the alternate impingement of two separate motor vehicle functional elements (1, 2), in particular two motor vehicle door latches (1, 2). The activation unit possesses a single motor (3, 4) and two connecting elements (8, 10). The motor (3, 4) impinges either the distanced first functional element (1) via the connecting element (8) or the distanced second functional element (2) via the second connecting element (10) dependent on its working direction. According to the invention, the first connecting element (8) is connected to a first lever (7) and the second connecting element (10) to a second lever (9). The respective lever (7, 9) is impinged dependent on the working direction of the motor (3, 4) which preferably works in a linear manner. Furthermore, the two levers (7, 9) are connected via an interposed spring (15).

12 Claims, 5 Drawing Sheets

(51) Int. Cl.

| | |
|---|---|
| ***E05C 9/16*** | (2006.01) |
| ***E05C 3/12*** | (2006.01) |
| ***E05C 9/20*** | (2006.01) |
| ***E05C 19/14*** | (2006.01) |
| ***E05B 81/06*** | (2014.01) |
| ***E05B 83/36*** | (2014.01) |
| ***E05B 81/14*** | (2014.01) |
| ***E05B 81/12*** | (2014.01) |
| *E05B 81/28* | (2014.01) |

(52) U.S. Cl.
CPC ..... *E05B 81/14* (2013.01); *E05B 81/25* (2013.01); *E05B 83/36* (2013.01); *E05C 3/12* (2013.01); *E05C 9/20* (2013.01); *E05C 19/14* (2013.01); *E05B 81/28* (2013.01); *Y10S 292/21* (2013.01); *Y10S 292/42* (2013.01); *Y10T 292/1082* (2015.04)

(58) Field of Classification Search
USPC ..... 296/56, 57.1, 106, 146.8, 51
See application file for complete search history.

(56) References Cited

U.S. PATENT DOCUMENTS 4,273,368 A * 6/1981 Tanaka ..... E05B 83/16 292/48
4,333,269 A 6/1982 Bascou
4,374,597 A * 2/1983 Mochida ..... F16C 1/10 292/336.3
4,470,276 A * 9/1984 Bayless ..... E05C 7/02 292/37
4,526,057 A * 7/1985 Mochida ..... E05B 53/005 292/336.3
4,691,584 A * 9/1987 Takaishi ..... E05B 81/06 292/144
4,900,088 A * 2/1990 Bechtle ..... B60N 2/20 292/28
5,035,449 A * 7/1991 Shiratori ..... E05B 83/16 292/48
5,688,004 A * 11/1997 Karge ..... E05B 47/0012 292/201
5,823,026 A * 10/1998 Finke ..... E05B 47/0002 70/276
5,947,536 A * 9/1999 Mizuki ..... E05B 63/143 292/201
6,017,067 A * 1/2000 Yoneyama ..... E05B 83/16 292/216
6,099,048 A * 8/2000 Salmon ..... E05B 77/52 292/201
6,135,513 A * 10/2000 Hamada ..... E05B 77/26 292/201
6,343,494 B2 * 2/2002 Roos ..... E05B 85/10 292/144
6,398,271 B1 * 6/2002 Tomaszewski ..... E05B 81/06 292/201
6,431,618 B1 * 8/2002 Choo ..... E05B 83/16 292/216
6,467,320 B1 * 10/2002 Choo ..... E05B 83/16 292/DIG. 29
6,779,820 B2 * 8/2004 Ogino ..... E05B 83/16 292/216
6,902,213 B2 * 6/2005 Lee ..... E05B 81/06 292/216
7,040,675 B1 * 5/2006 Ott ..... B60J 7/19 292/123
7,165,800 B2 * 1/2007 Thiele ..... B60P 1/26 16/366
8,336,929 B2 * 12/2012 Halliwell ..... E05B 15/021 292/216

* cited by examiner

REVERSIBLE ACTIVATION UNIT FOR ALTERNATE IMPINGEMENT OF TWO SEPARATE MOTOR VEHICLE FUNCTIONAL ELEMENTS

The invention relates to a reversible activation unit for alternate impingement of two separate motor vehicle functional elements, in particular two motor vehicle door latches, with a single motor, and with two connecting elements, whereby the motor, dependent on its working direction, either impinges the distanced first functional element via the first connecting element or the distanced second functional element via the second connecting element.

BACKGROUND

Such a reversible activation unit is described in DE 38 07 087 A1 as an example. This involves a latching device for the tailgate of a motor vehicle with a tightening device driven by an auxiliary motor usable for at least one further function. A locking mechanism of a corresponding motor vehicle door latch is transferred into its main ratchet position via a pre-ratchet position with the aid of the tightening device. The drive motor of a rear windscreen wiper system acts as an auxiliary motor. i.e. the only drive motor works both on the motor vehicle door latch and also on the rear windscreen wiper system as two motor vehicle functional elements separate from one another. Thus, a cost-effective and compact construction is already provided.

The tightening device works independently of the door latch. Both the drive of the wiper system and the drive of the tightening device are impinged by a common drive shaft which is set in motion by the drive motor executed as an electromotor. The reversible drive motor is engaged with the gearbox of either the mechanism of the wiper system or that of the tightening device dependent on the respective rotational direction of the motor. For this purpose, the tightening device is equipped inter alia with a reduction gear. Consequently, despite an overall compact construction, the mechanical details are complicated.

A comparable and mechanically similarly complicated construction is pursued in U.S. Pat. No. 4,333,269 which again has recourse to a single electromotor which impinges a tailgate on the one hand and a pertaining tailgate latch on the other hand. Again, this fundamentally depends on the working direction of the reversible electromotor.

The state of the art cannot satisfy in all aspects. Thus, work generally takes place with a single motor, which impinges either the first functional element or the second functional element dependent on its working direction. To this end, a first connecting element or a second connecting element is interposed in which the state of the art can respectively involve more or fewer wings, gear wheels, cog wheels, etc. As a consequence hereof, the construction is relatively complicated mechanically. This does not lead to increased weight, but can also entail functional impairments. This is where the invention as a whole wishes to provide assistance.

SUMMARY

The invention addresses the technical problem of further developing such a reversible activation unit for alternate impingement of two separate motor vehicle functional elements in such a way that functional safety is increased compared to the state of the art and the mechanical effort is reduced.

In order to solve this technical problem, a class-specific reversible activation unit for the alternate impingement of two separate motor vehicle functional elements within the scope of the invention is characterized in that the first connecting element is connected to a first lever and the second connecting element to a second lever, whereby the respective lever is impinged dependent on the working direction of the preferably linear motor, and whereby both levers are connected via an interposed spring.

Within the scope of the invention, it is initially envisaged that the motor which generally works in a linear manner either impinges the first lever or the second lever. This generally takes place via an adjusting lever impinged by the motor which executes a linear movement. The adjusting lever constitutes a component of the motor.

Due to this advantageous linear movement of the adjusting lever or the motor, the relevant and relevantly impinged first lever or second lever is pivoted. Because the two levers are typically formed as pivoting levers and demonstrate a common axis or a rotational axis.

The pivoting movement of the lever impinged by the adjusting lever linearly controlled by the motor is now converted into a relevant pulling or pushing movement. This pulling or pushing movement impinges the connecting element connected to the respective lever. As a consequence hereof, the connecting element works on the motor vehicle functional element connected to the end side, also for the purpose of a pulling or pushing impingement.

In order to transmit this pulling or pushing impingement from the lever via the connecting element to the motor vehicle functional element to be impinged, the respective connecting element advantageously involves a flexible connecting element, such as a Bowden cable, for example. Such a Bowden cable can transmit both pulling forces and also pushing forces. Alternatively, the connecting element can also be a connecting rod. Such a connecting rod is also capable of transmitting pulling and pushing forces onto the motor vehicle functional element to be impinged if required. Of course, combinations are also conceivable.

The motor vehicle functional element to be impinged is a motor vehicle door latch in each instance according to an especially preferred design form. In fact, the reversible activation unit according to the invention may ensure that the relevant motor vehicle door latch is opened. This happens as described alternately, in such a way that either the first motor vehicle door latch or the second motor vehicle door latch experiences the desired opening with the aid of the reversible activation unit according to the invention.

Such arrangements with several motor vehicle door latches are used on a motor vehicle, for example, if loading doors need to be variously opened/closed. Furthermore, such configurations are conceivable with sliding doors which can be moved against one another. For example, reference is made to U.S. Pat. No. 5,040,390, which describes a divided tailgate so to speak with a lower flap component and an upper window component.

The lower flap component is detachably connected with the chassis via two lateral latches. In addition, a central latch is provided for which ensures the detachable connection with the window component. However, the central latch and one or both lateral latches are alternately impinged. For example, this can take place with the reversible activation unit according to the invention.

The two levers are generally respectively two-armed levers with a connecting arm for the connecting element and a stop arm. Furthermore, an impingement arm can be provided for the motor. In this context, the connecting arm and the stop arm can be located opposite to one another with regard to the axis or rotational axis. However, it is also possible that the connecting arm and the stop arm are arranged on the same side in relation to the axis. In addition, the impingement arm is respectively provided for. The stop arm and the connecting arm are opposite with regard to the axis or rotational axis of the lever. The connecting arm and the impingement arm usually coincide.

As already explained, the motor preferably works in a linear manner. As a consequence hereof, the adjusting lever impinged by the motor is extended and retracted in a linear manner compared to the motor housing. Furthermore, the reversible activation unit is advantageously equipped with a connecting element according to the invention. The motor works on the pertaining lever via the connecting element. In detail, the connecting element can impinge the relevant lever either by pushing or pulling.

For this purpose, the connecting element is advantageously equipped with an engagement opening for the adjusting lever impinged by the motor which detachably engages herein, for example. If the motor has impinged the first lever or the second lever via the adjusting lever, the motor is typically subsequently switched off. A completely extended or retracted adjusting lever in relation to the housing of the motor corresponds to this. This extended or retracted relation to the housing is in contrast to the central neutral position.

The neutral position is executed and converted with the aid of the spring interposed between the two levers. For this purpose, the spring is advantageously a two-armed spring with two arms connected to a wound connecting section. The connecting section generally surrounds a bolt which defines the common axis for the two levers formed as pivoting levers.

The first arm of the two-armed spring generally engages into a recess of the first lever while the other second arm of the two-armed spring is adjacent to or arranged on a stop of the second level. The procedure can also take place vice versa. Then the first arm of the two-armed spring is adjacent to a stop of the first lever, while the other second arm of the two-armed spring engages into a recess of the second lever. Usually, the other second arm of the spring engages into a further recess of the second lever.

However, in both cases the respective arms of the two-armed spring are braced on the one hand on the first lever and on the other hand on the second lever which are respectively located pivotably around the common axis. As a consequence hereof, in the neutral position and without impingement by the motor the relevant spring ensures that the two levers are spread by the spring in an impinged manner. Advantageously, the configuration is such that the lever respectively not impinged by the motor functions as a stop for the impinged lever on the resetting movement initiated by the spring.

i.e. as soon as one of the two levers is impinged with the aid of the motor, the arm of the two-armed spring coupled with the relevant impinged lever is pivoted or tensioned. As soon as the motor now no longer impinges the relevant lever and generally goes into its retracted position, the tensioned two-armed spring ensures that the previously impinged lever is reset into its neutral position. Alternate stops on the levers ensure that this neutral position can be reproducibly assumed. Thus, the arrangement with the two levers and the respectively connected connecting elements are configured in a centering manner so to speak and it is ensured that in the case of a non-impinged motor neither of the motor vehicle functional elements experience impingement. This all succeeds taking into account a functional, easy and cost-effective configuration. These are the crucial advantages.

BRIEF DESCRIPTION OF THE DRAWINGS

Hereinafter, the invention is explained in further detail on the basis of a sketch which only depicts an execution example. It shows.

DETAILED DESCRIPTION

In the figures a reversible activation unit is depicted which serves for the alternate impingement of two separate motor vehicle functional elements 1, 2. The two motor vehicle functional elements 1, 2 are distanced from one another and respectively functionally separated. With the aid of the reversible activation unit to be described in detail below and with recourse to a single motor 3, 4 the two separate motor vehicle functional elements 1, 2 can now be alternately impinged. i.e. the single motor 3, 4 either ensures that the first motor vehicle functional element 1 or the second motor vehicle functional element 2 is impinged or experiences activation.

Figure 1:
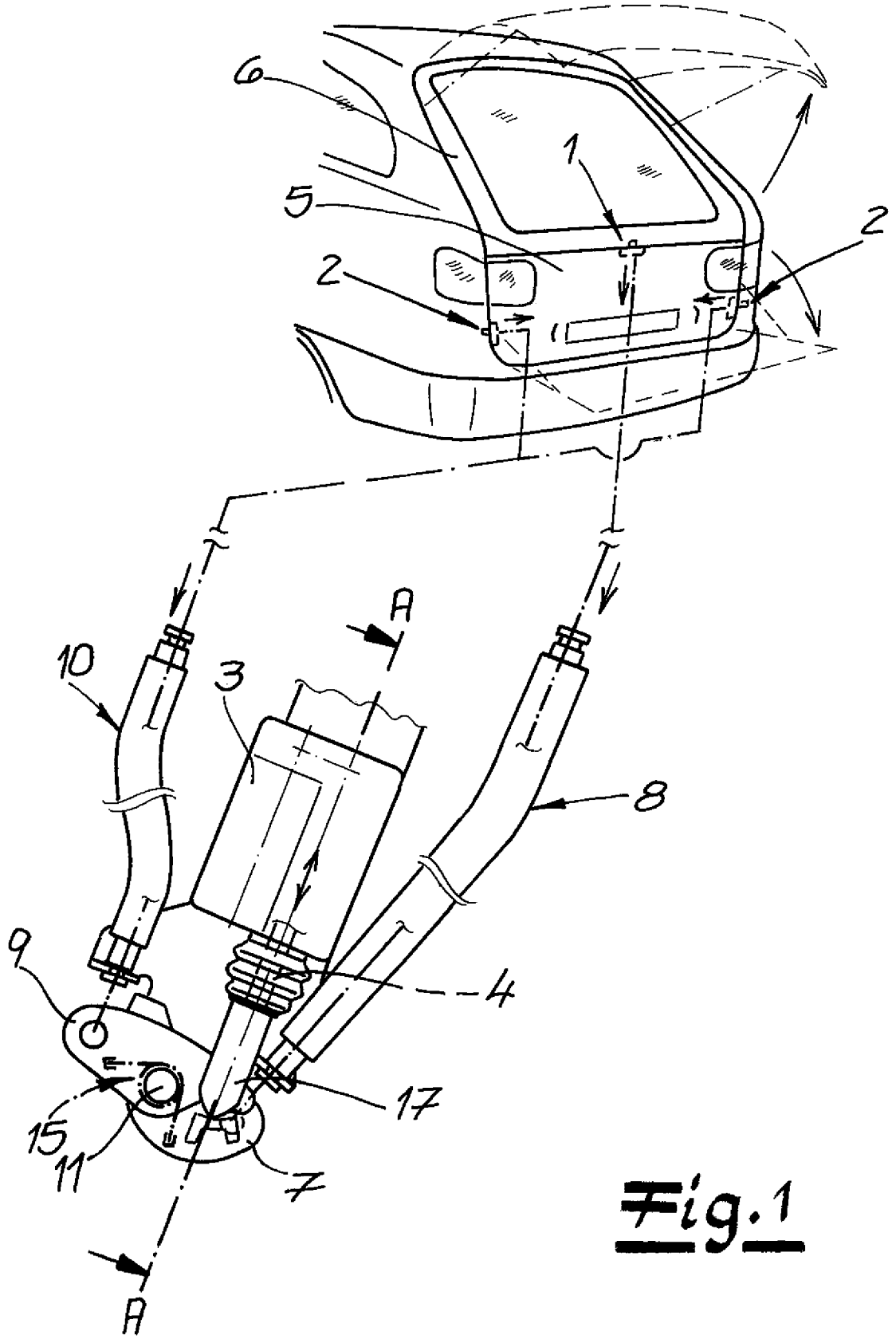
FIG. 1 The reversible activation unit according to the invention in an overview, FIG. 2 The object according to FIG. 1 in the longitudinal section along the line A-A, FIG. 3 The activation unit in a neutral position, FIG. 4 The activation unit according to FIG. 3 with extended adjusting lever to impinge the first lever and consequently the first motor vehicle functional element, and FIG. 5 The adjusting lever with a retracted movement with impingement of the second lever and consequently the second motor vehicle functional element.

Within the scope of the execution example, the two separate motor vehicle functional elements 1, 2 are respectively motor vehicle door latches 1, 2. On the basis of the diagrammatic representation in FIG. 1, it is recognized that the motor vehicle door latch 1 is formed as a central latch 1 in a lower flap element or flap component 5 of a divided tailgate 5, 6. In the second motor vehicle door latch 2, in the execution example and not restrictively it involves a lateral latch 2 or two lateral latches 2 also in the lower flap element or the flap component 5 of the divided tailgate 5, 6.

In fact, the divided tailgate 5, 6 comprises the relevant lower flap element or the lower flap component 5 on the one hand and the upper flap component or window component 6 on the other hand. Both components 5, 6 can be opened separately from one another. In order to open the window component 6 for example, it is necessary to open or unbolt the central latch 1. To this end, the depicted reversible activation unit works on the relevant central latch 1 with the aid of the motor 3, 4 via a first lever 7 with interposition of a first connecting element 8. If, in contrast the lower flap component 5 of the divided tailgate 5, 6 is opened, the reversible activation unit ensures that the motor 3, 4 works on a second lever 9 and a second connecting element 10 in order to open or unbolt the relevant lateral latch 2 or the two lateral latches 2. The two latches 1, 2 can also be activated consecutively in order to open the tailgate 5, 6 overall.

However, the reversible activation unit to be described in detail hereafter according to the invention ensures alternate impingement of the two separate motor vehicle functional elements 1, 2 or the two motor vehicle door latches 1, 2 in such a way that either the central latch 1 or the lateral latch 2 or the two lateral latches 2 in the execution example are opened. The respective connecting elements 8, 10 are respectively impinged in a pulling manner, as explained in detail hereafter. As the two connecting elements 8, 10 in the execution example respectively involve Bowden cables, the relevant pulling movement can be transmitted to the pertaining motor vehicle door latch 1, 2 arranged at the end of the Bowden cable. In principle, of course, a pushing impingement or both (pushing and pulling) is possible which is not shown and described, however.

As a result of the pulling movement exerted by the connecting element 8, 10 or the opening Bowden cable, for example, a pawl of a locking mechanism comprising a catch and a pawl can lift off the catch in the relevant motor vehicle door latch 1, 2. As a consequence hereof, a previously caught locking bolt is released in each instance and the window component 6 or the flap component 5 of the divided tailgate 5, 6 can accordingly be opened as described.

Figure 4:
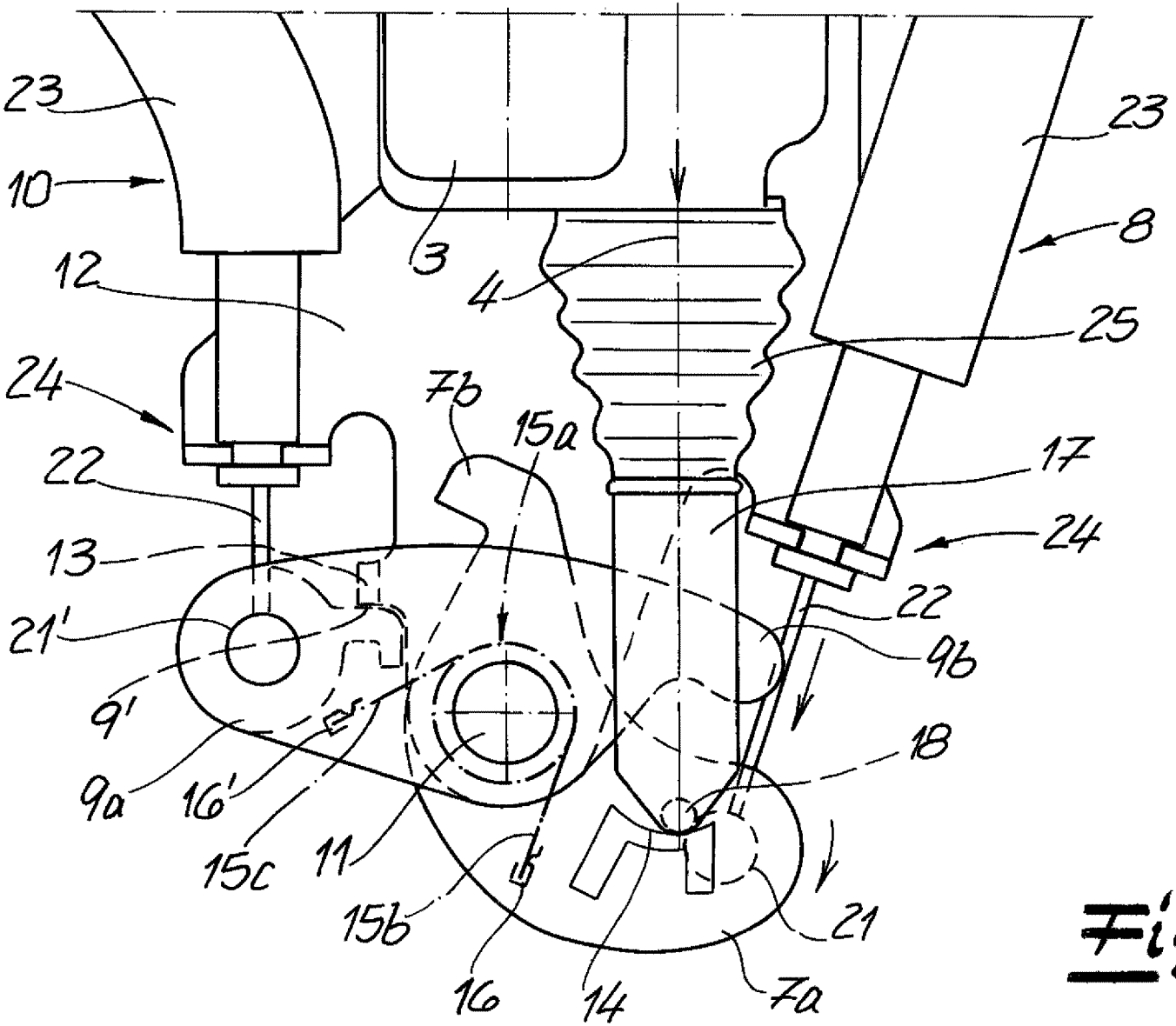
Figure 5:
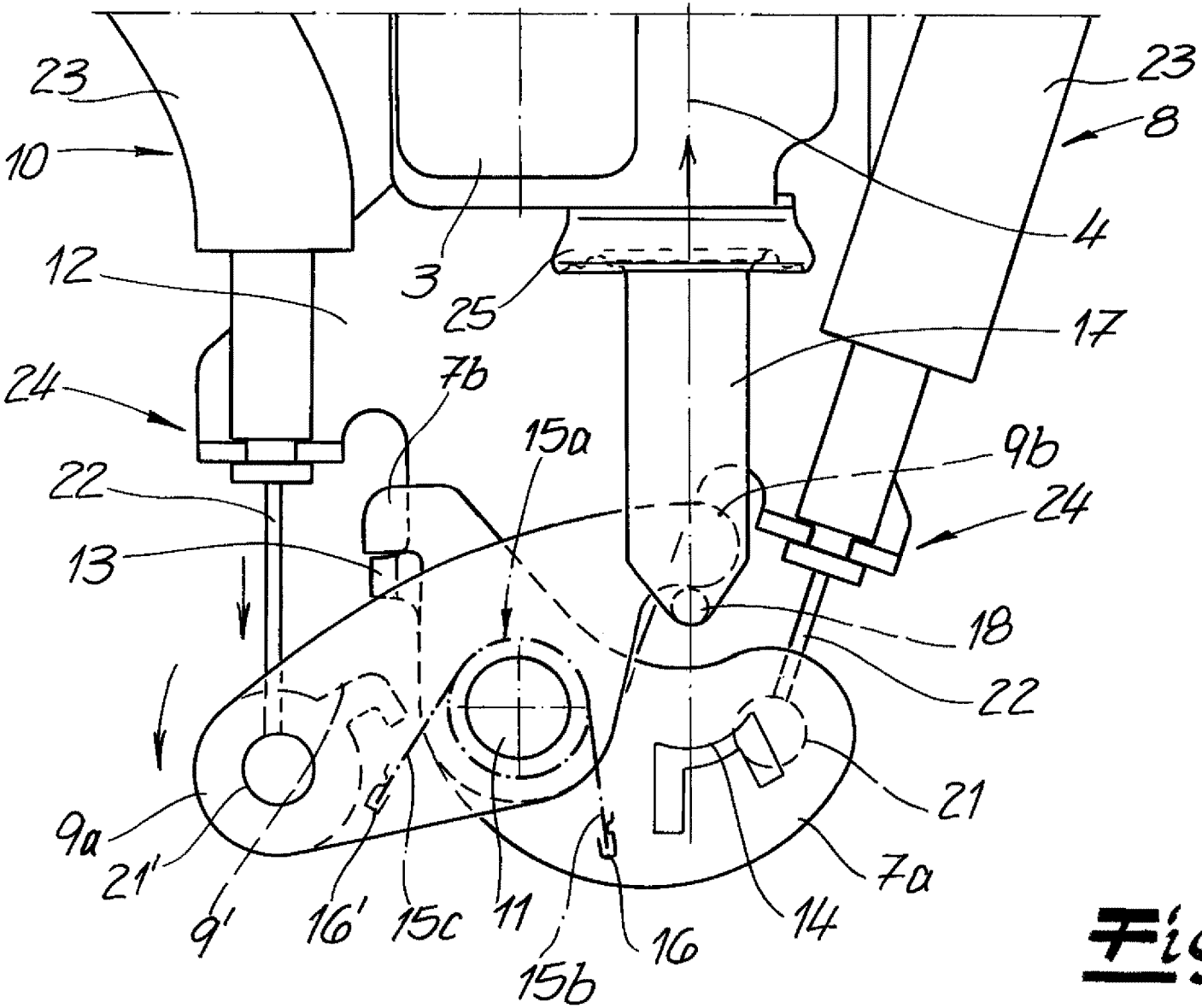

For this purpose, the motor 3, 4 works with different working directions either on the first lever 7 or the second lever 9. The different working directions of the motor 3, 4 are implemented in the execution example in such a way that the relevant motor 3, 4 works in a linear manner overall and possesses an adjusting lever 4 impinged by it, which executes an extending or a retracting movement according to FIG. 5 depicted accordingly in FIG. 4. This is indicated by corresponding arrows in FIGS. 4 and 5. Thus, the motor 3, 4 works in a linear and reversible manner overall and can therefore be impinged in both opposite working directions with regard to its 'extended' working direction according to FIG. 4 or its 'retracted' working direction for the purpose of FIG. 5. To this end, another polarity generally corresponds according to the execution example in the impingement of the motor 3, 4 configured as an electromotor. This change in polarity can be undertaken with the aid of a control unit which is not illustrated. However, the adjusting lever 4 can either extend, as illustrated in FIG. 4 or can be retracted according to the reproduction in FIG. 5. In contrast, a switch-off of the motor 3, 4 corresponds to the motor 3, 4 assuming a neutral position according to FIG. 3.

The two aforementioned levers 7, 9 pertain to the basic construction. Both levers 7,9 are formed as pivoting levers and located around a common axis 11. Thus, a common bolt defining the axis 11 is executed. The bolt is connected to a mounting plate 12 which not only incorporates the bolt and consequently the two levers 7, 9 pivotably located thereon, but also acts as a base for the motor 3, 4. At the same time, the mounting plate 12 provides mountings for the two connectors 8, 10 or Bowden cables in such a way that the mounting plate 12 is equipped with relevant thrust bearings.

Figure 2:
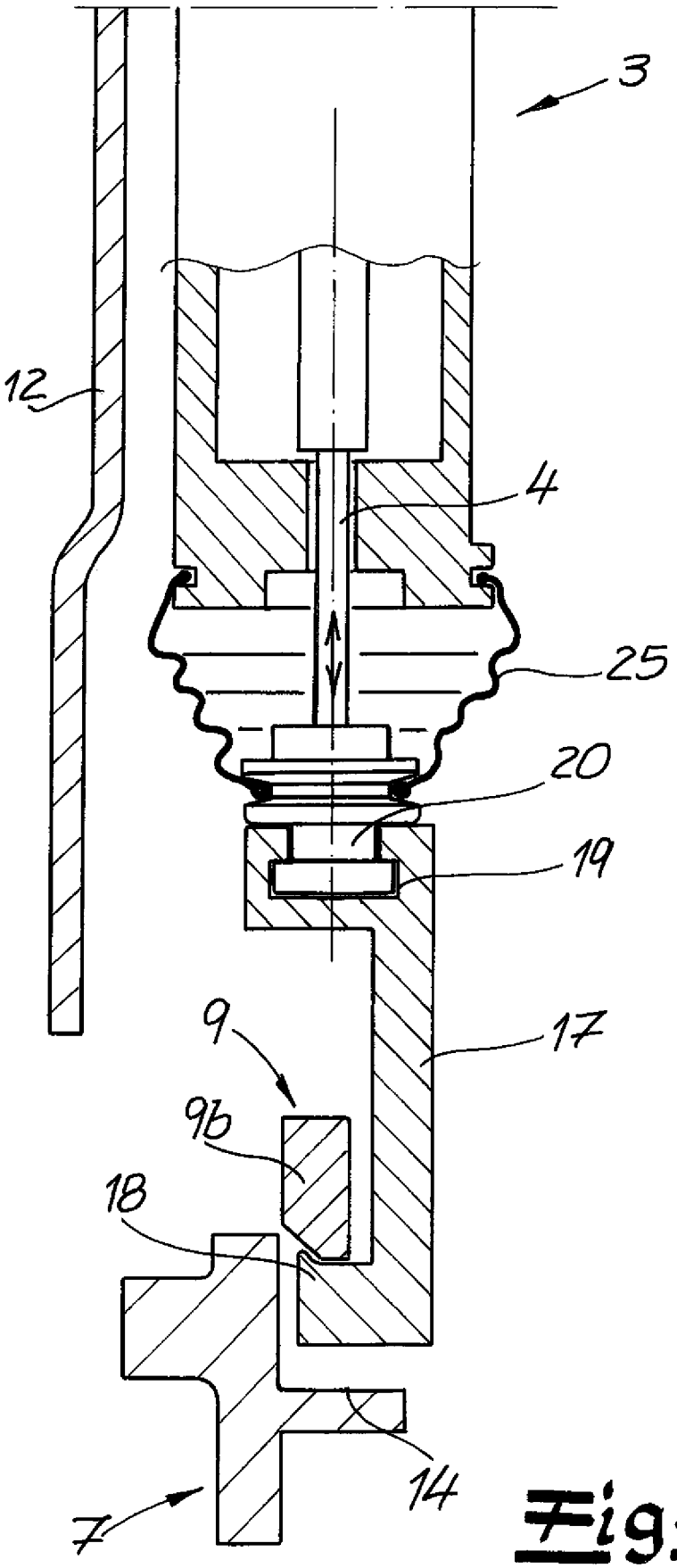

The respective lever 7, 9 is a two-armed lever. In fact, the respective lever 7,9 is equipped with a connecting arm 7*a*, 9*a* for the pertaining connecting element 8, 10 on the one hand and a stop arm 7*b*, 9*b* on the other hand. The stop arm 7*b* of the first lever 7 interacts with a stop 13 on the mounting plate 12 for this purpose. The second lever 9 is equipped with a stop arm 9*b* for interaction with a hook 18 of a connecting element 17 (cf. FIG. 2). Furthermore, the second lever 9 possesses a stop edge 9' which lies adjacent to the stop 13 in the neutral position according to FIG. 3.

Figure 3:
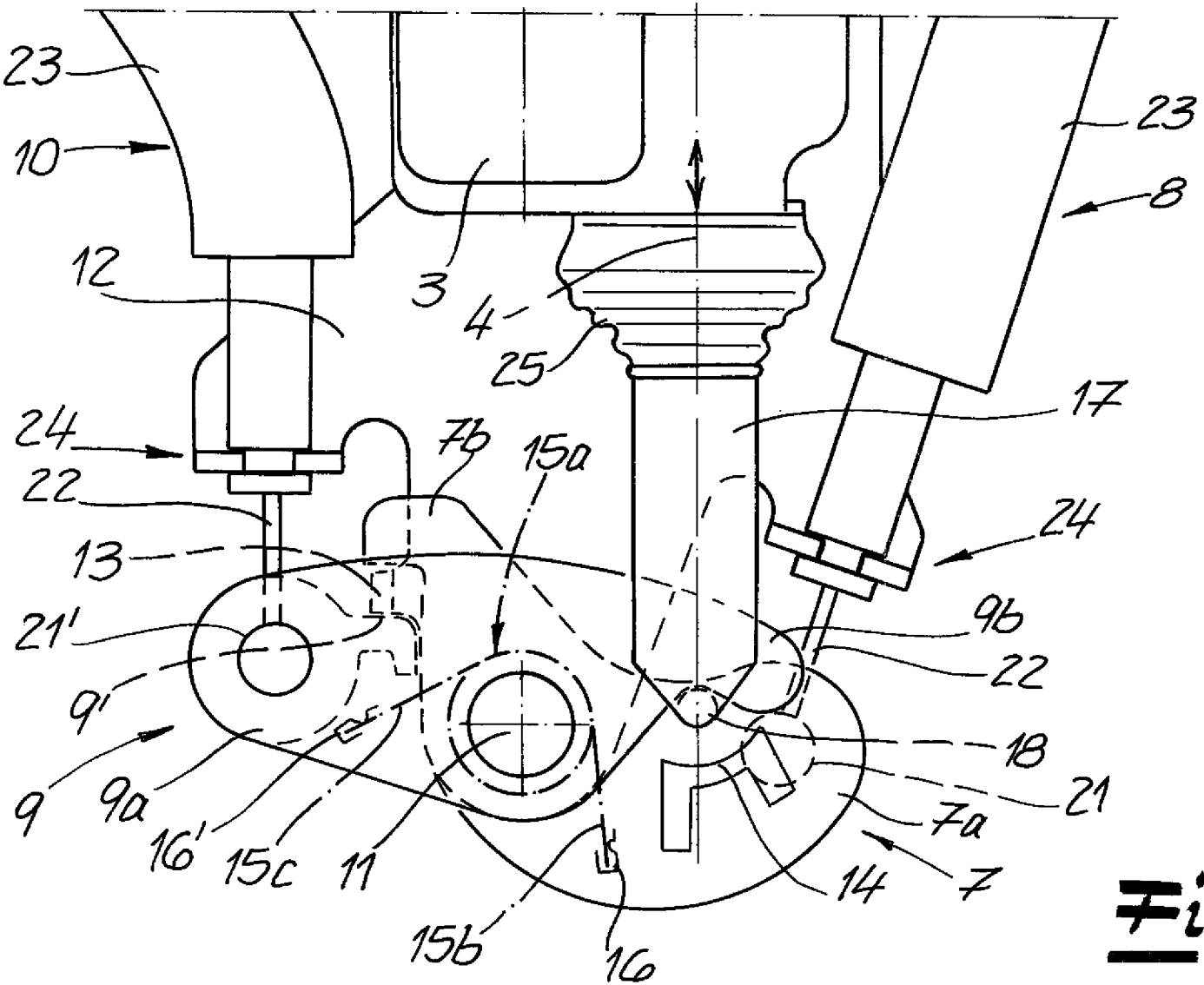

In conjunction with a spring 15 interposed between the two levers 7, 9 the stop 13 ensures overall that the two levers 7, 9 are spread out and assume their neutral position illustrated in FIG. 3. In the execution example, the spring 15 is a two-armed spring which ensures that the relevant lever 7, 9 is reset after an adjusting movement as described in more detail below.

In fact, the relevant spring 15 comprises a wound middle section 15*a* and two arms 15*b*, 15*c*. The wound middle section 15*a* of the spring 15 surrounds the bolt defining the common axis 11 for the two levers 7, 9. One of the spring arms 15*b* of the spring 15 is arranged in a recess 16 of the first lever 7. In contrast, the second arm 15*c* of the spring 15 is located in a recess 16' of the second lever 9. The stop 13 on the mounting plate 12 furthermore interacts with the connecting arm 9*a* of the second lever 9.

Finally, the connecting element 17 is recognized in the figures. The connecting element 17 is configured in such a way that the motor 3, 4 works on the pertaining lever 7, 9 via the connecting element 17. In particular, on the basis of the sectional view in FIG. 2 it is recognized that the relevant connecting element 17 is equipped with the hook 18 which reaches under the stop arm 9*b* of the second lever 9. Furthermore, the hook 18 of the connecting element 17 can enter into an arch-shaped recess of a stop 14 on the first lever 7. Furthermore, the connecting element 17 is equipped with an engagement opening 19. A head 20 of the adjusting lever 4 engages into the engagement opening 19 as a component of the motor 3, 4 (cf. FIG. 2).

It operates as follows. Starting from the neutralization according to FIG. 3, an extending movement of the adjusting lever 4 ensures as a component of the motor 3, 4 according to the reproduction in FIG. 4 that the connecting element 17 is moved downwards starting from the neutral position according to FIG. 3 in the execution example.

As a consequence hereof, the hook 18 enters the arch-shaped recess of the stop 14 and ensures that the first lever 7 bearing the stop 14 starting from the neutral position in FIG. 3 in the clockwise direction is pivoted around the axis 11. This is recognized in the transition from FIG. 3 to FIG. 4. As the connecting arm 7*a* of the first lever 7 is furthermore equipped with a mounting opening 21 for a bore 22 of a Bowden cable 22, 23 or the first connecting element 8, the relevant bore 22 is impinged in a pulling manner. Because a thrust bearing 24 provided for on the mounting plate 12 ensures that the relevant sheath 23 of the Bowden cable 22, 23 is held firm.

The pulling movement of the bore 22 of the Bowden cable 22, 23 thus executed is transmitted to the first motor vehicle door latch 1 or the central latch 1 in order to open it as described. To this end, the bore 22 may lift the pawl from the catch which then opens in a spring-assisted manner. Subsequently, the window component 6 of the divided tailgate 5, 6 can be pivoted upwards. After the end of this process, the motor 3, 4 is no longer energized and returns to its resting position according to FIG. 3. At the same time, a pair of bellows 25 surrounding the adjusting lever 4 and protected from environmental influences is retracted. The previously impinged first lever 7 is returned solely to its neutral position illustrated in FIG. 3 in a counterclockwise direction around its axis 11. The spring 15 initially ensures this return movement. Because the clockwise movement of the first lever 7 illustrated in FIG. 4 corresponds to the first spring arm 15*b* of the spring 15 also being pivoted and the spring 15 consequently being tensioned.

As soon as the impingement of the relevant lever 7 by the motor 3, 4 now ceases, the spring 15 can relax. The first lever 7 is pivoted back around its axis 11 in a counterclockwise direction. The pivoting movement is limited by the stop arm 7*b* of the first lever 7 hitting the stop 13 on the mounting plate 12.

If now instead of the previously impinged first lever 7 the second lever 9 is impinged, this corresponds to the adjusting lever 4 of the motor 3, 4 completing a retracted movement starting from the neutral position in FIG. 3. Hereby the second lever 9 is pivoted around its axis 11 in a clockwise direction starting from the neutral position in FIG. 3.

This pivoting movement is permitted to the extent that the connecting element 17 moves upwards hereby and the stop arm 9*b* carries along the second lever 9. As a further and comparatively constructed Bowden cable 22, 23 is connected with a thrust bearing 24 or the second connecting element 10 to the second lever 9 in a mounting opening 21' of its connecting arm 9*a*, the counterclockwise direction movement of the second lever 9 to be recognized in FIG. 5 leads to the relevant Bowden cable 22, 23 or its bore 22 being impinged again in a pulling manner. This pulling impingement on the other end of the Bowden cable 22, 23 ensures that the lateral latch 2 connected hereto or the two lateral latches 2 are opened. As a consequence hereof, the flap component 5 of the divided tailgate 5, 6 can be opened.

In order to execute the countermovement or return movement of the connecting element 17 illustrated in FIG. 5 and consequently the adjusting lever 4 as a component of the motor 3, 4, it is proceeded in the execution example in such a way that the relevant motor 3, 4 is impinged with a polarity opposite to the extension movement according to FIG. 3. This can easily be performed with the aid of a control unit.

After the second lever 9 has accomplished the movement in a counterclockwise direction around its axis 11 illustrated in FIG. 5 and consequently the lateral latch 2 has been opened, the impingement or energization of the motor 3, 4 ceases. The motor 3, 4 accordingly assumes its position illustrated in FIG. 3 again. The previous counterclockwise movement of the second lever 9 leads to the second spring arm 15*c* of the spring 15, which is adjacent in the recess 16' of the second lever 9 in the previously described process being tensioned. The same then naturally also applies to the entire spring 15.

As soon as the impingement by the motor 3, 4 now ceases, the spring 15 can relax. Thus, the second lever 9 is returned around its axis 11 in a clockwise direction. This occurs until its stop edge 9' moves against the stop 13 on the mounting plate 12. The stop 13 therefore ensures that the return movement initiated by the spring 15 of the previously impinged lever or second lever 9 is limited.

The invention claimed is:

1. A reversible activation unit for the alternate impingement of separate first and second motor vehicle functional elements, the reversible activation unit comprising:

a single motor having a motor connecting element that is movable in a linear manner between a neutral position and first and second opposing directions;

discrete first and second connecting elements;

discrete first and second levers, wherein the first connecting element operatively connects the first lever to the first motor vehicle functional element, and the second connecting element operatively connects the second lever to the second motor vehicle functional element, and a spring interposed between the first and second levers for biasing each lever to the neutral position, wherein when the motor moves the motor connecting element in the first direction from the neutral position, the motor connecting element contacts the first lever to move the first lever, independently from the second lever, to operate the first motor vehicle functional element via the first connecting element, and wherein when the motor moves the motor connecting element in the second direction from the neutral position, the motor connecting element contacts the second lever to move the second lever, independently from the first lever, to operate the second motor vehicle functional element via the second connecting element.

2. The reversible activation unit according to claim 1, wherein the first and second levers are formed as pivoting levers rotatable about a common axis.

3. The reversible activation unit according to claim 2, wherein the first and second levers are formed as two-armed levers with a connecting arm for the connecting element and a stop arm.

4. The reversible activation unit according to claim 3, wherein the connecting arm and the stop arm are opposite one another with regard to the common axis.

5. The reversible activation unit according to claim 3, wherein the connecting element includes a hook that engages the stop arm.

6. The reversible activation unit according to claim 5, wherein the connecting element either impinges the first lever or the second lever in a pushing or pulling manner.

7. The reversible activation unit according to claim 5, wherein the connecting element includes an engagement opening for an adjusting lever that is a component of the motor.

8. The reversible activation unit according to claim 1, wherein the spring is a two-armed spring with two arms connected to a wound connecting section.

9. The reversible activation unit according to claim 8, wherein a first arm of the spring engages into a first recess of the first lever and a second arm of the spring is arranged in a second recess of the second lever.

10. The reversible activation unit according to claim 1, wherein one of the first lever and the second lever which is not impinged is configured as a stop for the other impinged lever of the first lever and the second lever.

11. The reversible activation unit according to claim 1, wherein the first lever and the second lever at least partially overlap.

12. The reversible activation unit according to claim 1, wherein the first and second motor vehicle functional elements are latches.

* * * * *